US008580469B2

(12) United States Patent
Kmiecik-Lawrynowicz et al.

(10) Patent No.: US 8,580,469 B2
(45) Date of Patent: Nov. 12, 2013

(54) COLORED TONERS

(75) Inventors: Grazyna E. Kmiecik-Lawrynowicz, Fairport, NY (US); Maura A. Sweeney, Irondequoit, NY (US); Mark E. Mang, Rochester, NY (US); Kirk L. Stamp, Rochester, NY (US); Robert D. Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 49 days.

(21) Appl. No.: 13/327,497

(22) Filed: Dec. 15, 2011

(65) Prior Publication Data

US 2013/0157188 A1 Jun. 20, 2013

(51) Int. Cl.
*G03G 9/09* (2006.01)

(52) U.S. Cl.
USPC ..... 430/108.1; 430/109.3; 430/109.4; 430/110.2

(58) Field of Classification Search
USPC ..... 430/108.1, 109.3, 109.4, 110.2
See application file for complete search history.

(56) References Cited

U.S. PATENT DOCUMENTS

| | | | | |
|---|---|---|---|---|
| 7,700,252 | B2 | 4/2010 | Silence et al. | |
| 2008/0138730 | A1 * | 6/2008 | Lai et al. | 430/105 |
| 2008/0138732 | A1 * | 6/2008 | Lai et al. | 430/109.3 |
| 2009/0061343 | A1 * | 3/2009 | Lai et al. | 430/107.1 |
| 2010/0173239 | A1 * | 7/2010 | Iftime et al. | 430/107.1 |

* cited by examiner

*Primary Examiner* — Hoa V Le
(74) *Attorney, Agent, or Firm* — Judith L. Byorick

(57) ABSTRACT

Disclosed is a toner composition comprising: (a) a resin; and (b) a colorant which comprises: (1) Pigment Red 269; (2) Pigment Red 185; and (3) Pigment Red 122.

20 Claims, 3 Drawing Sheets

COLORED TONERS

BACKGROUND

Disclosed herein are toner compositions containing a plurality of colorants. More specifically, disclosed herein are toner compositions containing Pigment Red 269, Pigment Red 185, and Pigment Red 122.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference.

Polyester EA ultra low melt (ULM) toners have been prepared utilizing amorphous and crystalline polyester resins as disclosed in, for example, U.S. Pat. No. 7,547,499, the disclosure of which is totally incorporated herein by reference.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. Nos. 5,916,725 and 7,785,763 and U.S. Patent Publication 2008/0107989, the disclosures of each of which are totally incorporated herein by reference.

While known compositions and processes are suitable for their intended purposes, a need remains for toners with improved color gamut. In addition a need remains for toners exhibiting a "rosy-red" color that improve flesh tones in color images. Further, a need remains for toners with improved print performance. Additionally, a need remains for toners with optimized solid area density performance. There is also a need for emulsion aggregation toners with the above advantages. In addition, there is a need for emulsion aggregation toners with the above advantages that also have desirable particle morphology. Further, there is a need for toners, particularly emulsion aggregation toners, with the above advantages having narrow particle size distribution values.

SUMMARY

Disclosed herein is a toner composition comprising: (a) a resin; and (b) a colorant which comprises: (1) Pigment Red 269; (2) Pigment Red 185; and (3) Pigment Red 122. Also disclosed herein is a toner having: (a) an L* value of from about 42 to about 48; (b) an a* value of from about 79 to about 83; (c) a b* value of from about 10 to about 30; and (d) a C* value of from about 81 to about 85 for a 0.45 g/cm$^2$ sample of the toner on 0.22 μm white nitrocellulose membrane. Further disclosed herein is a toner composition comprising: (a) a resin; and (b) a colorant which comprises: (1) Pigment Red 269 in an amount of from about 35 to about 55 percent by weight of the colorant; (2) Pigment Red 185 in an amount of from about 26 to about 46 percent by weight of the colorant; and (3) Pigment Red 122 in an amount of from about 10 to about 30 percent by weight of the colorant; wherein a 0.45 g/cm$^2$ sample of the toner on 0.22 μm white nitrocellulose membrane has: (c) an L* value of from about 42 to about 48; (d) an a* value of from about 79 to about 83; (e) a b* value of from about 10 to about 30; and (f) a C* value of from about 81 to about 85.

DETAILED DESCRIPTION

Resins

Figure 1:
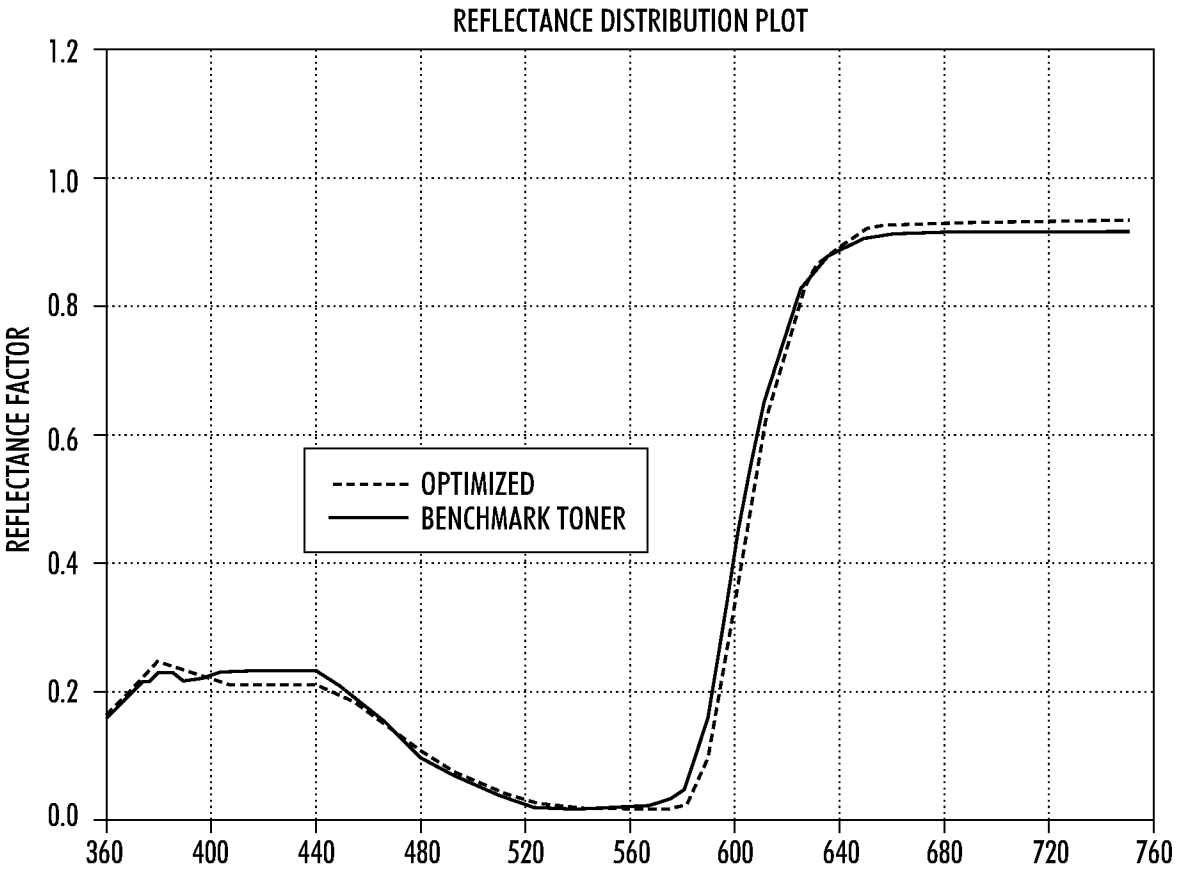
FIG. 1 is a reflectance distribution for the toner prepared in Example I and a comparative benchmark material.

The toners disclosed herein can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof, and the like.

Examples of suitable polyester resins include, but are not limited to, sulfonated, non-sulfonated, crystalline, amorphous, combinations thereof, and the like. The polyester resins can be linear, branched, combinations thereof, and the like. Polyester resins can include those resins disclosed in U.S. Pat. Nos. 6,593,049 and 6,756,176, the disclosures of each of which are totally incorporated herein by reference. Suitable resins also include mixtures of amorphous polyester resins and crystalline polyester resins as disclosed in U.S. Pat. No. 6,830,860, the disclosure of which is totally incorporated herein by reference.

Other examples of suitable polyesters include those formed by reacting a diol with a diacid or diester in the presence of an optional catalyst. For forming a crystalline polyester, suitable organic diols include, but are not limited to, aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol can be selected in any desired or effective amount, in one embodiment at least about 40 mole percent, in another embodiment at least about 42 mole percent and in yet another embodiment at least about 45 mole percent, and in one embodiment no more than about 60 mole percent, in another embodiment no more than about 55 mole percent, and in yet another embodiment no more than about 53 mole percent, and the alkali sulfo-aliphatic diol can be selected in any desired or effective amount, in one embodiment 0 mole percent, and in another embodiment no more than about 1 mole percent, and in one embodiment no more than about 10 mole percent, and in another embodiment no more than from about 4 mole percent of the resin, although the amounts can be outside of these ranges.

Examples of suitable organic diacids or diesters for preparation of crystalline resins include, but are not limited to, oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and the like, as well as combinations thereof. The organic diacid can be selected in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent, although the amounts can be outside of these ranges.

Examples of suitable crystalline resins include, but are not limited to, polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific crystalline resins can be polyester based, such as poly (ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly (ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and the like, as well as mixtures thereof. The crystalline resin can be present in any desired or effective amount, in one embodiment at least about 5 percent by weight of the toner components, and in another embodiment at least about 10 percent by weight of the toner components, and in one embodiment no more than about 50 percent by weight of the toner components, and in another embodiment no more than about 35 percent by weight of the toner components, although the amounts can be outside of these ranges. The crystalline resin can possess any desired or effective melting point, in one embodiment at least about 30° C., and in another embodiment at least about 50° C., and in one embodiment no more than about 120° C., and in another embodiment no more than about 90° C., although the melting point can be outside of these ranges. The crystalline resin can have any desired or effective number average molecular weight (Mn), as measured by gel permeation chromatography (GPC), in one embodiment at least about 1,000, in another embodiment at least about 2,000, and in one embodiment no more than about 50,000, and in another embodiment no more than about 25,000, although the Mn can be outside of these ranges, and any desired or effective weight average molecular weight (Mw), in one embodiment at least about 2,000, and in another embodiment at least about 3,000, and in one embodiment no more than about 100,000, and in another embodiment no more than about 80,000, although the Mw can be outside of these ranges, as determined by Gel Permeation Chromatography using polystyrene standards. The molecular weight distribution (Mw/Mn) of the crystalline resin can be of any desired or effective number, in one embodiment at least about 2, and in another embodiment at least about 3, and in one embodiment no more than about 6, and in another embodiment no more than about 4, although the molecular weight distribution can be outside of these ranges.

Examples of suitable diacid or diesters for preparation of amorphous polyesters include, but are not limited to, dicarboxylic acids, anhydrides, or diesters, such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and the like, as well as mixtures thereof. The organic diacid or diester can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Examples of suitable diols for generating amorphous polyesters include, but are not limited to, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene glycol, and the like, as well as mixtures thereof. The organic diol can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Polycondensation catalysts which can be used for preparation of either the crystalline or the amorphous polyesters include, but are not limited to, tetraalkyl titanates such as titanium (iv) butoxide or titanium (iv) iso-propoxide, dialkyltin oxides such as dibutyltin oxide, tetraalkyltins such as dibutyltin dilaurate, dialkyltin oxide hydroxides such as butyltin oxide hydroxide, aluminum alkoxides, alkyl zinc, dialkyl zinc, zinc oxide, stannous oxide, and the like, as well as mixtures thereof. Such catalysts can be used in any desired or effective amount, in one embodiment at least about 0.001 mole percent, and in one embodiment no more than about 5 mole percent based on the starting diacid or diester used to generate the polyester resin, although the amounts can be outside of these ranges.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific examples of amorphous resins which can be used include, but are not limited to, poly(styrene-acrylate) resins, crosslinked, for example, from about 10 percent to about 70 percent, poly(styrene-acrylate) resins, poly(styrene-methacrylate) resins, crosslinked poly (styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof. Alkali sulfonated polyester resins can be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), and the like, as well as mixtures thereof.

Unsaturated polyester resins can also be used. Examples of such resins include those disclosed in U.S. Pat. No. 6,063,827, the disclosure of which is totally incorporated herein by reference. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and the like, as well as mixtures thereof.

One specific suitable amorphous polyester resin is a poly (propoxylated bisphenol A co-fumarate) resin having the following formula:

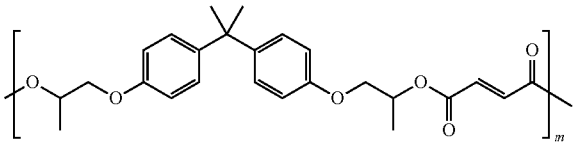

wherein m can be from about 5 to about 1000, although m can be outside of this range. Examples of such resins and processes for their production include those disclosed in U.S. Pat. No. 6,063,827, the disclosure of which is totally incorporated herein by reference. In a specific embodiment, a mixture of two amorphous resins of this structure is selected, one having weight average molecular weight (Mw) of from about 16,000 to about 30,000 and number average molecular weight (Mn) of from about 3,500 to about 4,500, and another having Mw of from about 60,000 to about 100,000 and Mn of from about 3,000 to about 4,000, although the Mw and Mn values can be outside of these ranges.

Also suitable are the polyester resins disclosed in U.S. Pat. No. 7,528,218, the disclosure of which is totally incorporated herein by reference. Specific examples of suitable resins include (1) the polycondensation products of mixtures of the following diacids:

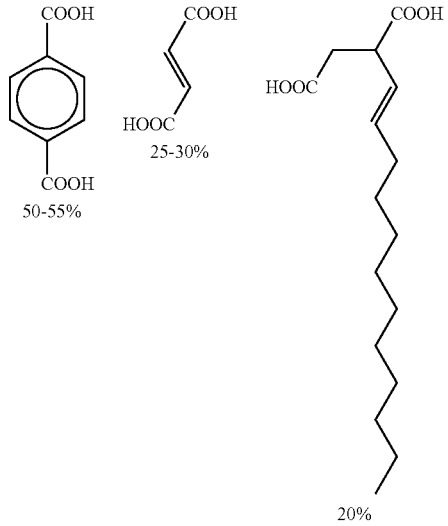

and the following diols:

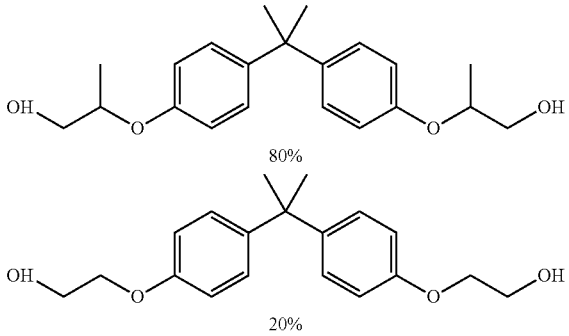

and (2) the polycondensation products of mixtures of the following diacids:

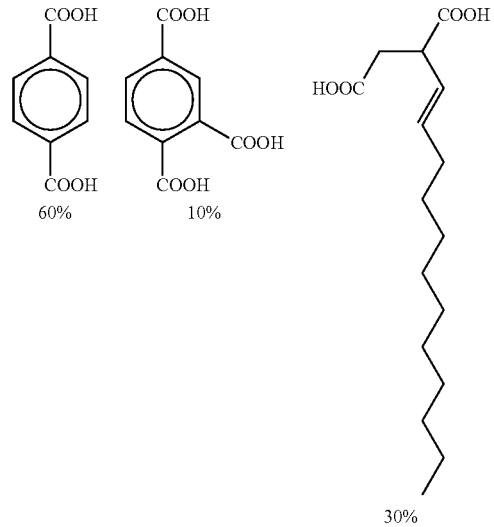

and the following diols:

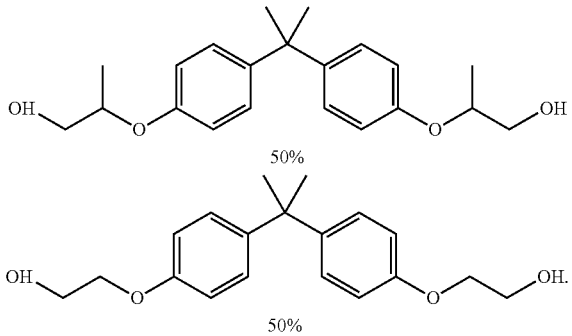

One example of a linear propoxylated bisphenol A fumarate resin which can be used as a latex resin is available under the trade name SPARII from Resana S/A Industrias Quimicas, Sao Paulo Brazil. Other propoxylated bisphenol A fumarate resins that can be used and are commercially available include GTUF and FPESL-2 from Kao Corporation, Japan, and EM181635 from Reichhold, Research Triangle Park, N.C., and the like.

Suitable crystalline resins also include those disclosed in U.S. Pat. No. 7,329,476, the disclosure of which is totally incorporated herein by reference. One specific suitable crystalline resin comprises ethylene glycol and a mixture of dodecanedioic acid and fumaric acid co-monomers with the following formula:

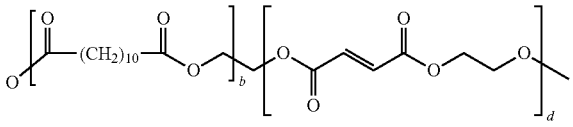

wherein b is from about 5 to about 2000 and d is from about 5 to about 2000, although the values of b and d can be outside of these ranges. In a specific embodiment, the Mw is from about 20,000 to about 25,000 and the Mn is from about 6,000 to about 8,000, although Mw and Mn can be outside of these ranges. Another suitable crystalline resin is of the formula

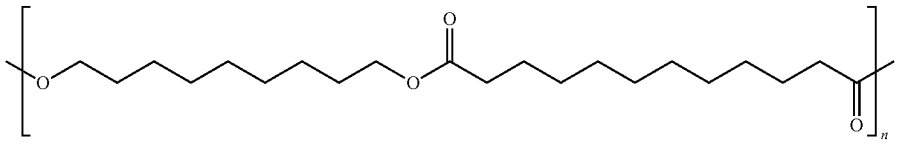

wherein n represents the number of repeat monomer units.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butyl acrylate-beta carboxy ethyl acrylate), and the like, as well as mixtures thereof. The polymers can be block, random, or alternating copolymers, as well as combinations thereof. In a specific embodiment, the polymer is a styrene/n-butyl acrylate/β-carboxyethyl acrylate copolymer wherein the molar ratio of monomers is from about 69 to about 90 parts styrene, from about 9 to about 30 parts n-butyl acrylate, and from about 1 to about 10 parts β-carboxyethyl acrylate, wherein the Mw value is from about 30,000 to about 40,000, and wherein the Mn value is from about 8,000 to about 15,000, although the molar ratio of monomers, Mw, and Mn can be outside of these ranges.

Emulsification

The emulsion to prepare emulsion aggregation particles can be prepared by any desired or effective method, such as a solventless emulsification method or phase inversion process as disclosed in, for example, U.S. Patent Publications 2007/0141494 and 2009/0208864, the disclosures of each of which are totally incorporated herein by reference. As disclosed in 2007/0141494, the process includes forming an emulsion comprising a disperse phase including a first aqueous composition and a continuous phase including molten one or more ingredients of a toner composition, wherein there is absent a toner resin solvent in the continuous phase; performing a phase inversion to create a phase inversed emulsion comprising a disperse phase including toner-sized droplets comprising the molten one or more ingredients of the toner composition and a continuous phase including a second aqueous composition; and solidifying the toner-sized droplets to result in toner particles. As disclosed in 2009/0208864, the process includes melt mixing a resin in the absence of a organic solvent, optionally adding a surfactant to the resin, optionally adding one or more additional ingredients of a toner composition to the resin, adding to the resin a basic agent and water, performing a phase inversion to create a phase inversed emulsion including a disperse phase comprising toner-sized droplets including the molten resin and the optional ingredients of the toner composition, and solidifying the toner-sized droplets to result in toner particles.

Also suitable for preparing the emulsion is the solvent flash method, as disclosed in, for example, U.S. Pat. No. 7,029,817, the disclosure of which is totally incorporated herein by reference. As disclosed therein, the process includes dissolving the resin in a water miscible organic solvent, mixing with hot water, and thereafter removing the organic solvent from the mixture by flash methods, thereby forming an emulsion of the resin in water. The solvent can be removed by distillation and recycled for future emulsifications.

Any other desired or effective emulsification process can also be used.

Toner

The toner particles can be prepared by any desired or effective method. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654, 6,365,312, 4,937,167, and 5,302,486, the disclosures of each of which are totally incorporated herein by reference, conventional melt-mixing and extrusion processes, ball milling, spray drying, the Banbury method, or the like. Toner compositions and toner particles can be prepared by aggregation and coalescence processes in which small-size resin particles are aggregated to the appropriate toner particle size and then coalesced to achieve the final toner-particle shape and morphology.

Toner compositions can be prepared by emulsion-aggregation processes that include aggregating a mixture of an optional colorant, an optional wax, any other desired or required additives, and emulsions including the selected resins described above, optionally in surfactants, and then coalescing the aggregate mixture. A mixture can be prepared by adding an optional colorant and optionally a wax or other materials, which can also be optionally in a dispersion(s) including a surfactant, to the emulsion, which can also be a mixture of two or more emulsions containing the resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

Optionally, a wax can also be combined with the resin and other toner components in forming toner particles. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges. Examples of suitable waxes include (but are not limited to) those having, for example, a weight average molecular weight of in one embodiment at least about 500, and in another embodiment at least about 1,000, and in one embodiment no more than about 20,000, and in another embodiment no more than about 10,000, although the weight average molecular weight can be outside of these ranges. Examples of suitable waxes include, but are not limited to, polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax, and the like; ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include, but are not limited to, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™, 89™, 130™, 537™, and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. Waxes can be included as, for example, fuser roll release agents. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges.

Colorants

The toners disclosed herein contain a colorant which comprises a mixture of Pigment Red 269, Pigment Red 185, and Pigment Red 122. These numbers are Color Index numbers.

In one specific embodiment, the pigments are present in relative amounts, by weight, as follows: about 2.5 parts Pigment Red 269, about 2 parts Pigment Red 185, and about 1 part Pigment Red 122, ±10% of each value, although the relative amounts can be outside of these ranges.

In another specific embodiment, the Pigment Red 269 is present in the mixture of three pigments in an amount of in one embodiment at least about 35 percent by weight, in another embodiment at least about 40 percent by weight, and in yet another embodiment at least about 45 percent by weight, and in one embodiment no more than about 55 percent by weight, in another embodiment no more than about 52 percent by weight, and in yet another embodiment no more than about 50 percent by weight, although the amount can be outside of these ranges. In this embodiment, the Pigment Red 185 is present in the mixture of three pigments in an amount of in one embodiment at least about 26 percent by weight, in another embodiment at least about 30 percent by weight, and in yet another embodiment at least about 36 percent by weight, and in one embodiment no more than about 46 percent by weight, in another embodiment no more than about 40 percent by weight, and in yet another embodiment no more than about 38 percent by weight, although the amount can be outside of these ranges. In this embodiment, the Pigment Red 122 is present in the mixture of three pigments in an amount of in one embodiment at least about 10 percent by weight, in another embodiment at least about 14 percent by weight, and in yet another embodiment at least about 18 percent by weight, and in one embodiment no more than about 30 percent by weight, in another embodiment no more than about 26 percent by weight, and in yet another embodiment no more than about 22 percent by weight, although the amount can be outside of these ranges.

The CIE L*a*b* coordinates of a color indicate its lightness or darkness (wherein L*=0 indicates black and L*=100 indicates white) and its hue (wherein a* indicates position on the red/magenta and green scale, with negative values indicating green and positive values indicating magenta, and wherein b* indicates position on the blue and yellow scale, with negative values indicating blue and positive values indicating yellow). C* is a measure of chroma, or the vividness of a color; in graph representation terms the value is a representation of how far the color is from the origin point of 0,0. A 0.45 gram per square centimeter sample of toner as disclosed herein, when suspended in solution, filtered out onto a 0.22 μm white nitrocellulose membrane (Millipore #GSWP04700), dried, and then fused in a fusing envelope, has an L* value of in one embodiment at least about 42, in another embodiment at least about 43, and in yet another embodiment at least about 44, and in one embodiment no more than about 48, in another embodiment no more than about 47, and in yet another embodiment no more than about 46, although the value can be outside of these ranges. This same sample has an a* value of in one embodiment at least about 79, in another embodiment at least about 80, and in yet another embodiment at least about 81, and in one embodiment no more than about 84, in another embodiment no more than about 83, and in yet another embodiment no more than about 82, although the value can be outside of these ranges. This same sample has a b* value of in one embodiment at least about 10, in another embodiment at least about 15, and in yet another embodiment at least about 20, and in one embodiment no more than about 30, in another embodiment no more than about 28, and in yet another embodiment no more than about 25, although the value can be outside of these ranges. This same sample has a C* value of in one embodiment at least about 81, in another embodiment at least about 82, and in yet another embodiment at least about 83, and in one embodiment no more than about 85, in another embodiment no more than about 84, and in yet another embodiment no more than about 83, although the value can be outside of these ranges.

The colorant mixture is present in the toner in any desired or effective total amount, in one embodiment at least about 1 percent by weight of the toner, and in another embodiment at least about 2 percent by weight of the toner, and in one embodiment no more than about 25 percent by weight of the toner, and in another embodiment no more than about 15 percent by weight of the toner, although the amount can be outside of these ranges.

Toner Preparation

The pH of the resulting mixture can be adjusted by an acid, such as acetic acid, nitric acid, or the like. In specific embodiments, the pH of the mixture can be adjusted to from about 2 to about 4.5, although the pH can be outside of this range. Additionally, if desired, the mixture can be homogenized. If the mixture is homogenized, homogenization can be performed by mixing at from about 600 to about 4,000 revolutions per minute, although the speed of mixing can be outside of this range. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1 percent by weight, in another embodiment at least about 0.2 percent by weight, and in yet another embodiment at least about 0.5 percent by weight, and in one embodiment no more than about 8 percent by weight, and in another embodiment no more than about 5 percent weight of the resin in the mixture, although the amounts can be outside of these ranges.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes, although more or less time can be used. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, although the mixing speed can be outside of these ranges, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C., although the temperature can be outside of these ranges.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with a Coulter Counter, for average particle size. Aggregation can thus proceed by maintaining the elevated temperature, or by slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

Shell Formation

A shell can then be applied to the formed aggregated toner particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates. In one specific embodiment, an amorphous polyester can be used to form a shell over the aggregates to form toner particles having a core-shell configuration.

In one specific embodiment, the shell comprises the same amorphous resin or resins that are found in the core. For example, if the core comprises one, two, or more amorphous resins and one, two, or more crystalline resins, in this embodiment the shell will comprise the same amorphous resin or mixture of amorphous resins found in the core. In some embodiments, the ratio of the amorphous resins can be different in the core than in the shell.

Once the desired final size of the toner particles is achieved, the pH of the mixture can be adjusted with a base to a value in one embodiment of from about 6 to about 10, and in another embodiment of from about 6.2 to about 7, although a pH outside of these ranges can be used. The adjustment of the pH can be used to freeze, that is to stop, toner growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts from about 2 to about 25 percent by weight of the mixture, and in more specific embodiments from about 4 to about 10 percent by weight of the mixture, although amounts outside of these ranges can be used.

Coalescence

Following aggregation to the desired particle size, with the formation of the shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C., although temperatures outside of these ranges can be used, which can be below the melting point of the crystalline resin to prevent plasticization. Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours, although periods of time outside of these ranges can be used.

After coalescence, the mixture can be cooled to room temperature, typically from about 20° C. to about 25° C. (although temperatures outside of this range can be used). The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner, although amounts outside of these ranges can be used. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner, although amounts outside these ranges can be used. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

The toner particles can be formulated into a developer composition. The toner particles can be mixed with carrier particles to achieve a two-component developer composition. The toner concentration in the developer can be of any desired or effective concentration, in one embodiment at least about 1 percent, and in another embodiment at least about 2 percent, and in one embodiment no more than about 25 percent, and in another embodiment no more than about 15 percent by weight of the total weight of the developer, although amounts outside these ranges can be used.

The toner particles have a circularity of in one embodiment at least about 0.920, in another embodiment at least about 0.940, in yet another embodiment at least about 0.962, and in still another embodiment at least about 0.965, and in one embodiment no more than about 0.999, in another embodiment no more than about 0.990, and in yet another embodiment no more than about 0.980, although the value can be outside of these ranges. A circularity of 1.000 indicates a completely circular sphere. Circularity can be measured with, for example, a Sysmex FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.15, in another embodiment at least about 1.18, and in yet another embodiment at least about 1.20, and in one embodiment no more than about 1.40, in another embodiment no more than about 1.35, in yet another embodiment no more than about 1.30, and in still another embodiment no more than about 1.25, although the value can be outside of these ranges.

The toner particles can have a volume average diameter (also referred to as "volume average particle diameter" or "$D_{50v}$") of in one embodiment at least about 3 μm, in another embodiment at least about 4 μm, and in yet another embodiment at least about 5 μm, and in one embodiment no more than about 25 μm, in another embodiment no more than about 15 μm, and in yet another embodiment no more than about 12 μm, although the value can be outside of these ranges. $D_{50v}$, GSDv, and GSDn can be determined using a measuring instrument such as a Beckman Coulter Multisizer 3, operated in accordance with the manufacturer's instructions. Representative sampling can occur as follows: a small amount of toner sample, about 1 gram, can be obtained and filtered through a 25 micrometer screen, then put in isotonic solution to obtain a concentration of about 10%, with the sample then run in a Beckman Coulter Multisizer 3.

The toner particles can have a shape factor of in one embodiment at least about 105, and in another embodiment at least about 110, and in one embodiment no more than about 170, and in another embodiment no more than about 160, SF1*a, although the value can be outside of these ranges. Scanning electron microscopy (SEM) can be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The characteristics of the toner particles may be determined by any suitable technique and apparatus and are not limited to the instruments and techniques indicated hereinabove.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C., although temperatures outside these ranges can be used.

The toner particles can have a dielectric loss value, which is a measure of conductivity of the toner particles, in one embodiment of no more than about 70, in another embodiment of no more than about 50, and in yet another embodiment of no more than about 40, although the value can be outside of these ranges.

Specific embodiments will now be described in detail. These examples are intended to be illustrative, and the claims are not limited to the materials, conditions, or process parameters set forth in these embodiments. All parts and percentages are by weight unless otherwise indicated.

COMPARATIVE EXAMPLE

Toner C

A magenta emulsion aggregation toner containing dual pigments (Pigment Red 269 and Pigment Red 122) was prepared in a 2 L jacketed glass reactor. Mixing to the reactor was provided by a 4 inch diameter mixing element 1 inch above the bottom of the reactor. The reactor was loaded with raw materials to yield about 250 g of dried toner particles. The target dry weights of the components are shown in the table below. The flocculant, acid, and base additions are not counted in the dry weight.

| Ingredient | Amt. (grams) | Amt. (wt. %) |
|---|---|---|
| Bulk Resin | 152.5 | 61 |
| Shell Resin | 70 | 28 |
| PR269 | 11.25 | 4.5 |
| PR122 | 3.75 | 1.5 |
| Paraffin Wax | 12.5 | 5 |

To the reactor about 381.9 g of a 41% solids polystyrene butyl-acrylate latex dispersion was added. In addition to the latex dispersion, about 69.71 g of a 17% solids PR269 dispersion, about 23.7 g of a 17% solids PR122 dispersion, and about 775 g of deionized water were added. An IKA-T50 homogenizer set to 4,000 rpm was inserted into the reactor. About 30 seconds after the homogenizer was turned on, about 42.33 g of a 30% solids wax dispersion was added slowly (over about 1 minute). As the mixture continued to be homogenized, the flocculant was added. In this case the flocculant was 3.5 g polyaluminum chloride diluted in 31.5 g of a 0.02M $HNO_3$ solution. The flocculant mixture was added slowly over about 3 minutes.

The homogenizer was then removed and the mixing element was set to 300 rpm. The jacket of the reactor was set to about 67° C. The particle size was monitored with a Coulter Counter until the particles reached an average volume particle size of about 5.6 microns. These were the core particles. To the core particles about 175 g of a 41% solids polystyrene butyl-acrylate latex dispersion was added over 11 minutes. This second addition of latex formed the shell so the resulting particles had a core-shell structure. The mixture continued to be mixed for 20 minutes after all the shell latex was added. At the end of the 20 minutes the pH of the slurry was adjusted with 1M NaOH to a pH of about 4.7. At this time the reactor jacket temperature was increased so the contents of the reactor reached about 96° C. to coalesce the aggregated particles. During the temperature ramp the pH of the slurry was again adjusted to about 4.0 with 0.3M $HNO_3$ when the slurry temperature reached about 90° C. When the slurry reached a temperature of about 96° C. the circularity of the particles was monitored with a Sysmex 3000 until a shape factor of 0.984 was achieved. When the desired shape factor was achieved the contents of the reactor were cooled to about 63° C. The pH of the slurry was again adjusted to about 10 using 1M NaOH. The toner slurry was then cooled to room temperature, separated by sieving (20 μm stainless steel sieve obtained from Fisher Scientific) and filtered, followed by washing and freeze drying the resulting toner particles.

EXAMPLE I

Toner A

A toner was prepared as described in Comparative Example A except that it contained three pigments instead of two, the third pigment being Pigment Red 185. The total pigment amount in this toner was about 6.7 percent by weight of the toner. The target dry weights of the components are shown in the table below.

| Ingredient | Amt. (grams) | Amt. (wt. %) |
|---|---|---|
| Bulk Resin | 143.25 | 57.3 |
| Shell Resin | 70 | 28 |
| PR185 | 6 | 2.4 |
| PR269 | 7.525 | 3.01 |
| PR122 | 3.225 | 1.29 |
| Paraffin Wax | 20 | 8 |

Toner was suspended into solution and then filtered out onto a 0.22 μm membrane (wet deposition). Multiple samples were generated by varying the mass. The samples were dried and then fused in a fusing envelope. The fusing envelope ensured a uniform topography to each sample so that the gloss remained a constant and was not a factor when measuring the color of each sample. The masses for the samples were 0.25, 0.35, 0.45, 0.55, 0.65, 0.75, 0.85, 0.95, 1.0, and 1.1 mg/cm$^2$.

Figure 2:
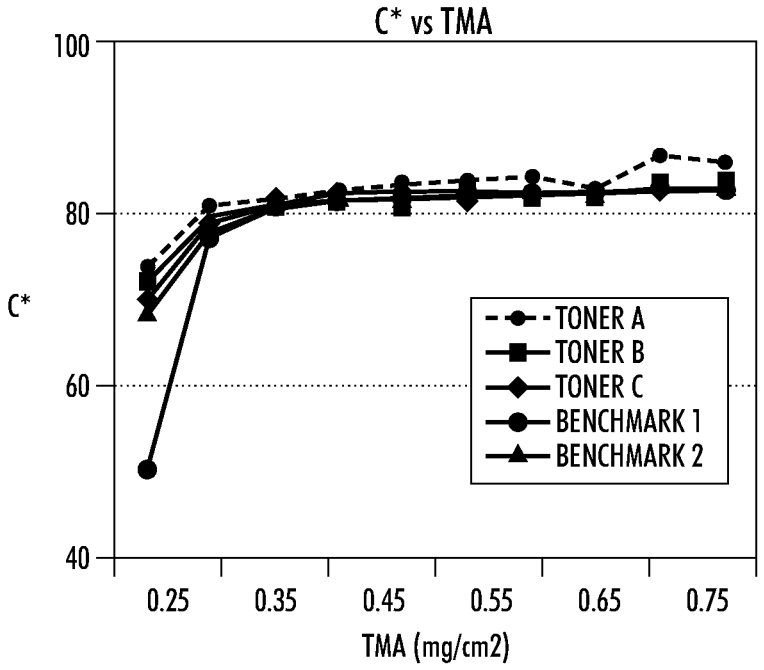
FIGS. 2 to 5 are plots of CIE L*a*b* values for toners prepared in Example I and a comparative benchmark material.
Figure 3:
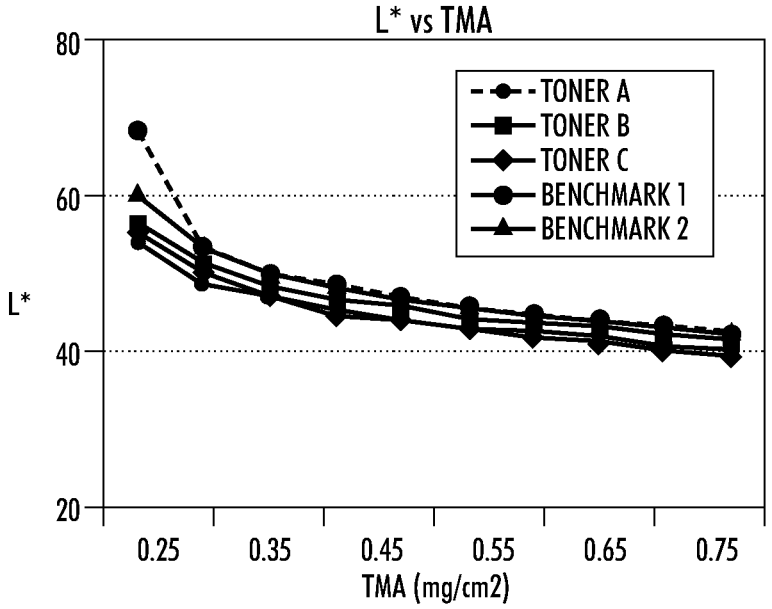
Figure 4:
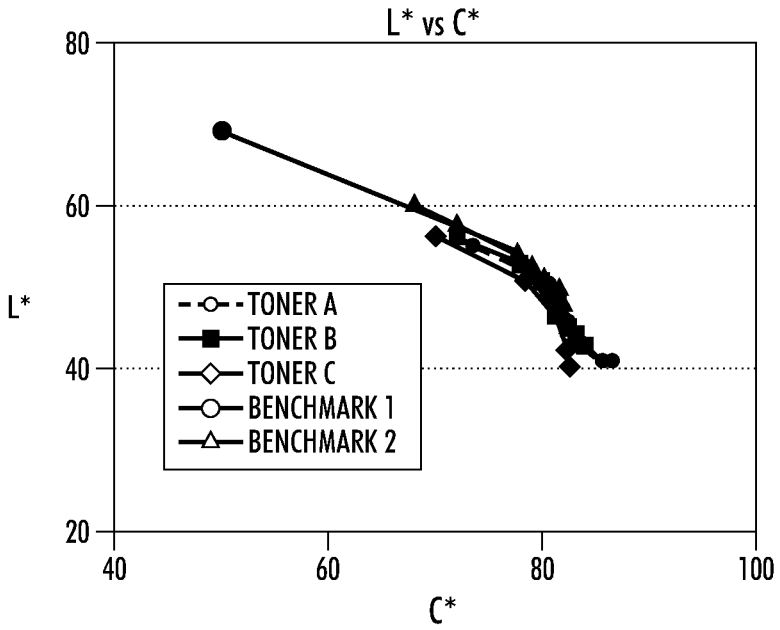
Figure 5:
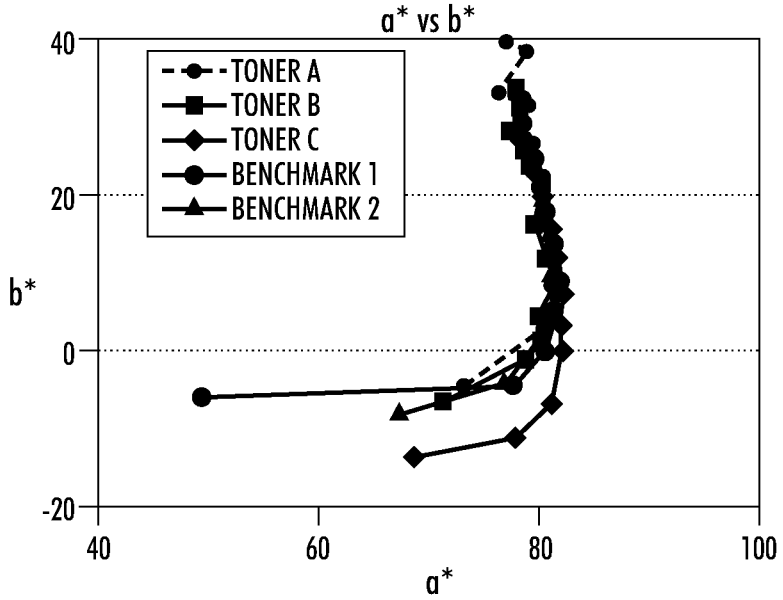

Three of the toners thus prepared were subjected to CIE L*a*b* color analysis. The results are shown in FIGS. 2 through 5, showing the results of the three toners compared to two desired benchmark results, wherein FIG. 2 shows C* vs. toner mass area (TMA, mg/cm$^2$). FIG. 3 shows L* vs. TMA, FIG. 4 shows L* vs. C*, and FIG. 5 shows a* vs. b*.

Delta E (ΔE) is a measure of color differences. In general, a ΔE value of 2.00 indicates a humanly visually perceived color difference, whereas a ΔE vale of less than 2.00 indicates no significant color difference and visually appear identical. When compared to a standard, lower ΔE values indicate a better match. Delta E can be calculated by different formulae; the values reported herein were calculated by the ΔE2000 formula, comparing the L*, a*, and b* values obtained by an X-RITE 939 color spectrophotometer. The L* (lightness), a* (yellow/blue color space), and b* (green/red color space) were calculated for each sample. The results were compared to a selected desirable benchmark using the Delta E2000 formula. The ΔE2000 value was 0.62, which was well below the human detection threshold.

A reflectance distribution was generated for the same samples. The reflectance factor is a measurement of the ratio of the intensity of light reflected from the sample to the intensity of light reflected from a perfect white diffuse reflector. The significance of this measurement is that color can be examined as a function of wavelength, which is a very discerning method to differential between colors. The color measurement is a measure of the image (toner deposit) on a nitrocellulose membrane (0.22 μm porosity, Millipore #GSWP04700). Several samples are prepared at increasing masses to provide a comprehensive understanding of how the lightness and chroma are affected. The gloss factor is nullified by keeping the topography constant from sample to sample. The illuminate used was D50 the observer angle was 0/45 degrees. The results are shown in FIG. 1. As the results indicate, the toner thus prepared, shown by a solid line, was a very close spectral match to the selected benchmark material, shown by a dotted line.

EXAMPLE II

Toner B

The process of Example I was repeated except that the toner contained the ingredients in the following relative amounts:

| Ingredient | Amt. (grams) | Amt. (wt. %) |
|---|---|---|
| Bulk Resin | 145.775 | 58.31 |
| Shell Resin | 70 | 28 |
| PR185 | 5.1 | 2..04 |
| PR269 | 6.4 | 2.56 |
| PR122 | 2.725 | 1.09 |
| Polyethylene Wax | 20 | 8 |

EXAMPLE III

An emulsion aggregation toner is prepared at the 2 L bench scale (175 g dry theoretical toner). Two amorphous polyester emulsions (97 g of an amorphous polyester resin in an emulsion (polyester emulsion A), having a Mw of about 19,400, an Mn of about 5,000, and a Tg onset of about 60° C., and about 35% solids and 101 g of an amorphous polyester resin in an emulsion (polyester emulsion B), having a weight average molecular weight (Mw) of about 86,000, a number average molecular weight (Mn) of about 5,600, an onset glass transition temperature (Tg onset) of about 56° C., and about 35% solids), 34 g of a crystalline polyester emulsion (having a Mw of about 23,300, an Mn of about 10,500, a melting temperature (Tm) of about 71° C., and about 35.4% solids), 5.06 g surfactant (DOWFAX 2A1), 51 g of polyethylene wax in an emulsion, having a Tm of about 90° C., and about 30% solids, and 112 g pigment dispersion are mixed. Both amorphous resins are of the formula

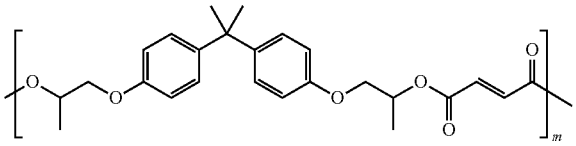

wherein m is from about 5 to about 1000. The crystalline resin is of the formula

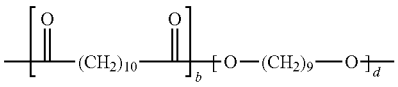

wherein b is from about 5 to about 2000 and d is from about 5 to about 2000. The pigment dispersion contains about 48 weight percent Pigment Red 269, about 35 weight percent Pigment Red 185, and about 17 weight percent Pigment Red 122.

Thereafter, the pH is adjusted to 4.2 using 0.3M nitric acid. The slurry is then homogenized for a total of 5 minutes at 3000-4000 rpm while adding in the coagulant (3.14 g $Al_2(SO_4)_3$ mixed with 36.1 g deionized water). The slurry is then transferred to the 2 L Buchi reactor and set mixing at 460 rpm. Thereafter, the slurry is aggregated at a batch temperature of 42° C. During aggregation, a shell comprising the same amorphous emulsions as in the core is pH adjusted to 3.3 with nitric acid and added to the batch. The batch then continues to achieve the targeted particle size. Once at the target particle size with pH adjustment to 7.8 using NaOH and EDTA, the aggregation step is frozen. The process proceeds with the reactor temperature being increased to achieve 85° C.; at the desired temperature the pH is adjusted to 6.5 using pH 5.7 sodium acetate/acetic acid buffer where the particles begin to coalesce. After about two hours the particles achieve a circularity of >0.965 and are quench-cooled with ice. The toner is washed with three deionized water washes at room temperature and dried using a freeze-dryer unit.

EXAMPLE IV

A magenta developer composition is prepared as follows. 92 parts by weight of a styrene-n-butylmethacrylate resin, 6 parts by weight of a magenta pigment mixture (said magenta pigment mixture containing about 47 weight percent Pigment Red 269, about 34 weight percent Pigment Red 185, and about 19 weight percent Pigment Red 122), and 2 parts by weight of cetyl pyridinium chloride are melt blended in an extruder wherein the die is maintained at a temperature of between about 130-145° C. and the barrel temperature ranges from about 80-100° C., followed by micronization and air classification to yield toner particles of a size of 12 μm in volume average diameter. Subsequently, carrier particles are prepared by solution coating a Hoeganoes Anchor Steel core with a particle diameter range of from about 75-150 microns, available from Hoeganoes Company, with 0.4 parts by weight of a coating comprising 20 parts by weight of Vulcan carbon black, available from Cabot Corporation, homogeneously dispersed in 80 parts by weight of a chlorotrifluoroethylene-vinyl chloride copolymer, commercially available as OXY 461 from Occidental Petroleum Company, which coating is solution coated from a methyl ethyl ketone solvent. The magenta developer is then prepared by blending 97.5 parts by weight of the coated carrier particles with 2.5 parts by weight of the toner, in a Lodige Blender for about 10 minutes.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A toner composition comprising:

(a) a resin; and (b) a colorant which comprises:

(1) Pigment Red 269 in an amount of from about 35 to about 55 percent by weight of the colorant;

(2) Pigment Red 185 in an amount of from about 26 to about 46 percent by weight of the colorant; and (3) Pigment Red 122 in an amount of from about 10 to about 30 percent by weight of the colorant.

2. A toner according to claim 1 further containing a surfactant.

3. A toner according to claim 1 wherein the colorant comprises:

(a) Pigment Red 269 in an amount of from about 40 to about 52 percent by weight of the colorant;

(b) Pigment Red 185 in an amount of from about 30 to about 40 percent by weight of the colorant; and (c) Pigment Red 122 in an amount of from about 14 to about 26 percent by weight of the colorant.

4. A toner composition comprising:

(a) a resin; and (b) a colorant which comprises:

(1) Pigment Red 269;

(2) Pigment Red 185; and (3) Pigment Red 122;

wherein the colorant comprises the Pigment Red 269, Pigment Red 185, and Pigment Red 122 in relative amounts, by weight, of about 2.5 parts Pigment Red 269, about 2 parts Pigment Red 185, and about 1 part Pigment Red 122, ±10% of each pigment.

5. A toner according to claim 1 wherein the colorant mixture is present in the toner in an amount of from about 1 to about 25 percent by weight of the toner.

6. A toner according to claim 1 wherein the toner is an emulsion aggregation toner.

7. A toner according to claim 1 wherein the resin comprises a styrene-butyl acrylate copolymer.

8. A toner according to claim 1 wherein the resin comprises a poly(styrene-butyl acrylate-beta carboxy ethyl acrylate).

9. A toner according to claim 8 wherein:

(a) the molar ratio of monomers is from about 69 to about 90 parts styrene, from about 9 to about 30 parts n-butyl acrylate, and from about 1 to about 10 parts β-carboxyethyl acrylate;

(b) the Mw value is from about 30,000 to about 40,000; and (c) the Mn value is from about 8,000 to about 15,000.

10. A toner according to claim 1 wherein the resin comprises a polyester.

11. A toner according to claim 1 wherein the resin comprises an amorphous polyester and a crystalline polyester.

12. A toner according to claim 11 wherein the amorphous polyester is of the formula

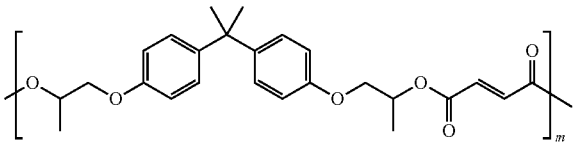

wherein m is from about 5 to about 1000 and the crystalline polyester is of the formula

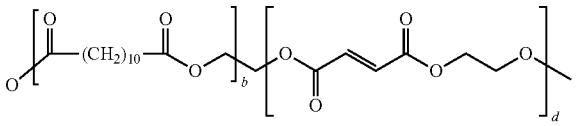

wherein b is from about 5 to about 2000 and d is from about 5 to about 2000.

13. A toner according to claim 12 wherein:

(a) the amorphous polyester comprises a mixture of two resins, (i) the first having:

(A) Mw of from about 16,000 to about 30,000; and (B) Mn of from about 3,500 to about 4,500; and (ii) the second having:

(A) Mw of from about 60,000 to about 100,000; and (B) Mn of from about 3,000 to about 4,000; and (b) the crystalline polyester having:

(i) Mw of from about 20,000 to about 25,000; and (ii) Mn of from about 6,000 to about 8,000.

14. A toner according to claim 1 wherein the toner further comprises a wax.

15. A toner according to claim 1 wherein the toner is encapsulated by a shell.

16. A toner according to claim 1 wherein a 0.45 g/cm$^2$ sample of the toner on 0.22 μm white nitrocellulose membrane has:

(a) an L* value of from about 42 to about 48;

(b) an a* value of from about 79 to about 83;

(c) a b* value of from about 10 to about 30; and (d) a C* value of from about 81 to about 85.

17. A toner composition comprising:

(a) a resin; and (b) a colorant which comprises:

(1) Pigment Red 269 in an amount of from about 35 to about 55 percent by weight of the colorant;

(2) Pigment Red 185 in an amount of from about 26 to about 46 percent by weight of the colorant; and (3) Pigment Red 122 in an amount of from about 10 to about 30 percent by weight of the colorant;

wherein a 0.45 g/cm$^2$ sample of the toner on 0.22 μm white nitrocellulose membrane has:

(c) an L* value of from about 42 to about 48;

(d) an a* value of from about 79 to about 83;

(e) a b* value of from about 10 to about 30; and (f) a C* value of from about 81 to about 85.

18. A toner according to claim 17 wherein the colorant comprises the Pigment Red 269, Pigment Red 185, and Pigment Red 122 in relative amounts, by weight, of about 2.5 parts Pigment Red 269, about 2 parts Pigment Red 185, and about 1 part Pigment Red 122, ±10% of each pigment.

19. A toner according to claim 4 wherein the toner is an emulsion aggregation toner.

20. A toner according to claim 4 wherein a 0.45 g/cm$^2$ sample of the toner on 0.22 μm white nitrocellulose membrane has:

(a) an L* value of from about 42 to about 48;

(b) an a* value of from about 79 to about 83;

(c) a b* value of from about 10 to about 30; and (d) a C* value of from about 81 to about 85.

* * * * *